US012479022B2

(12) United States Patent
Han

(10) Patent No.: US 12,479,022 B2
(45) Date of Patent: Nov. 25, 2025

(54) APPARATUS FOR EXTENDING SERVICE LIFE OF SHOT CHAMBER FOR DIE CASTING APPLICATION

(71) Applicant: Qingyou Han, Stow, OH (US)

(72) Inventor: Qingyou Han, Stow, OH (US)

( * ) Notice: Subject to any disclaimer, the term of this patent is extended or adjusted under 35 U.S.C. 154(b) by 0 days.

(21) Appl. No.: 18/959,363

(22) Filed: Nov. 25, 2024

(65) Prior Publication Data

US 2025/0091122 A1 Mar. 20, 2025

Related U.S. Application Data

(62) Division of application No. 18/105,813, filed on Feb. 4, 2023, now Pat. No. 12,179,258.

(51) Int. Cl.
*B22D 17/20* (2006.01)
*B22D 17/30* (2006.01)

(52) U.S. Cl.
CPC ..... *B22D 17/2023* (2013.01); *B22D 17/30* (2013.01)

(58) Field of Classification Search
CPC .... B22D 17/2023; B22D 17/30; B22D 39/00; B22D 41/12
See application file for complete search history.

(56) References Cited

U.S. PATENT DOCUMENTS 4,059,143 A * 11/1977 Morita ..... B22D 17/30 164/113
2007/0044937 A1* 3/2007 Bigelow ..... B22D 35/06 164/113
2007/0074842 A1* 4/2007 Manoff ..... B22D 17/2023 164/113
2009/0126897 A1* 5/2009 Han ..... B22D 1/007 164/511

FOREIGN PATENT DOCUMENTS

CN 110328350 A * 10/2019 ..... B22D 17/30
DE 19730895 A1 * 1/1999 ..... B22D 17/08
WO WO-9712709 A1 * 4/1997 ..... B22D 17/007

* cited by examiner

*Primary Examiner* — Kevin E Yoon
*Assistant Examiner* — Jacky Yuen

(57) ABSTRACT

An apparatus for extending service life of a shot chamber and for seasoning a molten alloy are provided. The apparatus can be placed on a shot chamber of a die casting machine, absorbing the impact of the molten alloy during pouring, delivering the molten alloy smoothly into a shot chamber, and seasoning the molten alloy so that the alloy can be die cast at temperatures below its liquidus. The use of such an apparatus is expected to significantly increase the service life and a shot chamber in addition to improve the mechanical properties of the resultant cast component.

9 Claims, 6 Drawing Sheets

APPARATUS FOR EXTENDING SERVICE LIFE OF SHOT CHAMBER FOR DIE CASTING APPLICATION

GRANT STATEMENT

The present U.S. patent application is a divisional application of U.S. patent application Ser. No. 18/105,813 filed Feb. 4, 2023. The relevant contents of this prior application are hereby incorporated by reference into the present disclosure.

FIELD OF THE INVENTION

The present invention relates to die casting, more specifically, to a liquid metal transporting device assembled on a shot chamber of a die casting machine.

BACKGROUND OF THE INVENTION

Die casting, also termed as high pressure die casting (HPDC), is a widely-used process that entails the injection of molten metal into a die cavity under high pressure. The molten metal, commonly aluminum, magnesium, zinc, their alloys, and sometimes copper, titanium, and their alloys, is transported into a shot chamber containing a cylindrical channel connected to the die cavity, and then is injected with a ram or plunger from the chamber to the die cavity, where it solidifies and forms solid components. Die casting is generally considered to be a cost-effective process capable of producing precision (net-shape) products at high production rates. Currently, die casting processes are used to produce over 70% of the annual tonnage of all aluminum castings in the United States.

There are two kinds of die casting processes: hot-chamber and cold-chamber die casting [1]. Aluminum castings are made using the cold-chamber die casting process [2]. In the cold-chamber process, a shot chamber, or shot sleeve, connected to the die cavity receives molten metal poured by a gravity pouring process through a pour hole located distantly from the die cavity. The molten metal stream impacts the inner surface of the shot sleeve under the pour hole, i.e., opposite to the pour hole, at relatively high speeds and subsequently fills the shot sleeve. Consequently, the shot sleeve at its internal surface suffers severe erosion by the corrosive molten metal. Shot sleeves normally fail from erosion under pour hole [3]. These sleeves are costly. In addition, the failure of a shot sleeve leads to machine downtimes at estimated costs of over a thousand dollars per hour.

Traditionally, shot sleeves are made of hot work steels such as H13 steel for die casting of aluminum alloys [3]. Erosion under pour hole occurs as the liquid metal poured into the steel dissolves a small amount of the steel shot sleeve on each shot. As erosion tends to occur faster when the steel substrate become hotter, erosion rates are increased with higher production rates and higher levels of melt superheat, as there is no sufficient time between shots for the sleeve to cool. Automatic ladling can also result in an increase in the amount of erosion under the pour hole [4-7], as the molten metal hit the same spot on inside of the sleeve shot-after-shot. An erosion pit will gradually form on the inside of shot sleeve under the pour hole over time. When the depth of the erosion pit is greater than a few millimeters, the shot sleeve is considered failed and has to be scrapped.

Methods for maximizing the service life of shot sleeve include 1) increasing the iron and manganese contents in the molten alloy to be cast, 2) using materials that are resistant to molten metal attack to build sleeves, 3) reducing the flow speeds when the molten alloy stream hits the internal surface of the shot sleeve under the pour hole, and 4) lowering the pouring temperature of the molten alloy.

Alloys used for making die castings are usually designed to minimize the dissolution of shot tooling steel in molten aluminum alloys and thus minimize the production costs. As a result, conventional aluminum die casting alloys contain a high content of iron and manganese so that iron is saturated in the molten alloys at pouring temperatures. Still, steel erosion and dissolution are problems which lead to an early failure of the die tooling such as the shot sleeve and the core pins [4-7]. Recent trend in automobile light weighting is pushing the die casting industry to make structural aluminum die castings using alloys containing low iron and manganese [8-9]. Failure of shot sleeve due to erosion under pour hole becomes a serious issue for making structural aluminum die castings. It is estimated that the service life of a shot sleeve for casting these new low iron aluminum alloys is only about 10% to 20% of that for casting of conventional high iron aluminum alloys.

Effort has been made to use expensive refractory metals to protect a shot sleeve in the regions under the pour hole in order to make the sleeve last longer. U.S. Pat. No. 3,786,552 to Saito et al. discloses a method of manufacturing a composite bimetallic shot sleeve to address the issue of erosion under pour hole. The shot sleeve is composed of a relatively thin inner layer made of highly an infusible material such as molybdenum, tungsten or their alloys, and an outer layer made of an iron-based alloy. The outer layer is made using a mixture of powders by sintering at high temperatures. U.S. Pat. No. 9,114,455 to Donahue et al. discloses a shot sleeve for die casting of low-iron aluminum silicon alloys and a manufacturing method. The shot sleeve includes an erosion resistant liner, i.e., an inner layer that fits with the bulk H13 steel sleeve within a small tolerance. The liner material is selected from a refractory metal including titanium, tungsten, molybdenum, ruthenium, tantalum, niobium and etc. U.S. patent application Ser. No. 15/463,345 by Han et al. discloses the use of refractory metals for the liner in a gooseneck. The use of a refractory metal liner extends service life but increases the costs of a shot sleeve.

The die casting industry has been pouring molten metal from a ladle as close to the pour hole of a shot sleeve as possible to minimize the speeds of the molten metal as it impacts the bottom surface of the sleeve. The die casting industry has also been pouring molten metal at melt temperatures as low as possible to minimize steel erosion. The pouring temperature has to be higher than the liquidus of an alloy because the massive steel sleeve extracts a substantial amount of heat from the molten metal as it fills the sleeve. Reducing pouring temperature of the molten metal would lead to increased casting defects, as dendrites that form from the melt within the cold sleeve tend to choke mold filling at the gates to the die cavity [2, 10-11].

However, slurry containing a fraction of spherical solid grains can be die cast at pouring temperatures much lower than the liquidus temperature of the alloy [12-13]. A molten metal can be seasoned in a vessel to produce slurry containing non-dendritic grains or spherical grains by means of agitation [13]. Such agitation can be induced by high-intensity ultrasonic vibrations [14-16], mechanical stirring [17-18], electromagnetic stirring [19], and gas bubbling [20] etc. Pouring such slurry into a sleeve would reduce steel erosion significantly and produce casting components with their mechanical properties superior to that pouring a liquid alloy.

Therefore, there is a need to develop a cost effective method and apparatus to slow down the formation of erosion pit under the pour hole of a shot sleeve by reducing the impact of melt flow on shot sleeve during pouring.

There is also a need to develop a cost effective method and apparatus that produces slurry containing spherical grains while reducing the impact of melt flow on shot sleeve during pouring.

SUMMARY OF THE INVENTION

In an exemplary embodiment of the present invention, a process of reducing the impact of a molten metal on a shot sleeve under the pour hole is provided. The process includes the step of pouring the molten metal into a device and delivering the molten metal at the outlets of the device to significantly change the flow direction and thus to reduce the impact of molten metal on the internal surface of a shot sleeve.

In another embodiment of the present invention, a process of delivering the molten metal to impact the side walls of a pour hole is provided. The process includes the step of pouring the molten metal into a device and delivering the molten metal at the outlets of the device aiming at the side walls of the pour hole. The molten metal is then flow smoothly along the side walls of the shot chamber so that the erosion to the working surfaces of the shot chamber is minimized.

In another embodiment of the present invention, a process of spreading the molten metal over a much large area under the pour hole than the conventional pouring process does is provided. Such a process allows the formation of a large and shallow pit under the pour hole and thus extending the service life of the shot sleeve.

In another embodiment of the present invention, a process of using a device for partially absorbing the impact of a molten metal during pouring is provided wherein the bottom wall of the device serves as a sacrificial wall in order to protect the shot sleeve.

Yet in another embodiment of the present invention, a process of seasoning a molten metal to produce slurry containing a small fraction of spherical solid grains is provided. Such a process would allow the slurry to impact a shot sleeve at temperatures much lower than the liquidus of the alloy.

DETAILED DESCRIPTION OF THE INVENTION

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

Figure 1:
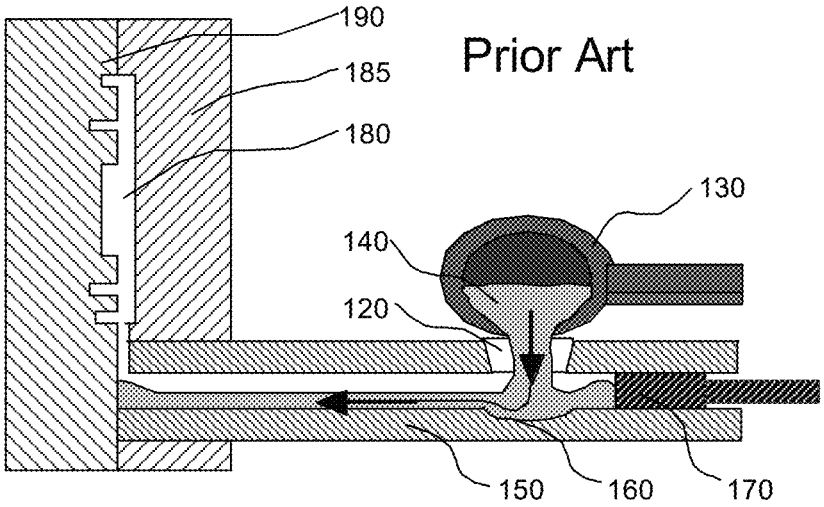
FIG. 1 is a schematic side view of a layout of a prior art on the pouring of a molten metal into a shot sleeve in the cold-chamber die casting process.

FIG. 1 illustrates erosion pit formation under pour hole during a conventional die casting process. Molten metal 140 is poured from a ladle 130 through a pour hole 120 into a shot sleeve 150. The molten metal 140 hits directly on the bottom internal surface of the shot sleeve 150 then flows sideway to fill the shot sleeve 150. The flow directions during pouring are illustrated using arrows in FIG. 1. After pouring, the molten metal 140 is pushed by a ram 170 to fill the mold cavity 180 formed by a fixed mold 185 and a moving mold 190 and solidified in the cavity 180 to form a casting before being removed from the mold cavity 180. The entire process from pouring the molten metal 140 to the ejection of a solidified casting from the mold cavity 180 is termed as a cycle or a shot. A shot sleeve 150 is usually used for many shots before it fails.

The molten metal 140 dissolves a small amount of the shot sleeve 150 on each shot. As the molten metal 140 hits the same spot on inside of the sleeve 150 and fills the shot sleeve 150 shot-after-shot, an erosion pit 160 is gradually formed under the pour hole 120. Since erosion occurs everywhere on the surface of the shot sleeve 150 that is in contact with the molten metal 140, the formation of an erosion pit 160 under the pour hole 120 is a strong indication that the erosion rate is dependent on the flow pattern during pouring and the amount of molten metal 140 flow over the surface of the shot sleeve 150. The flow component normal to the surface of a shot sleeve 150 causes more erosion of shot sleeve than that parallel to the surface. Given an amount of molten metal 140 during each shot, increasing contact area or reducing contact time between the molten metal 140 and shot sleeve 150 reduces pit formation. However, it is very difficult to increase the contact area when the molten metal 140 is poured into the small pour hole 120 from the ladle 130.

Another issue associated with the prior art shown in FIG. 1 is the splashing of molten metal 140 when the melt front hits the bottom surface of the shot sleeve during initial pouring. Such a splashing causes increased formation of oxide and increased entrapment of gases in the molten metal 140.

Figure 2:
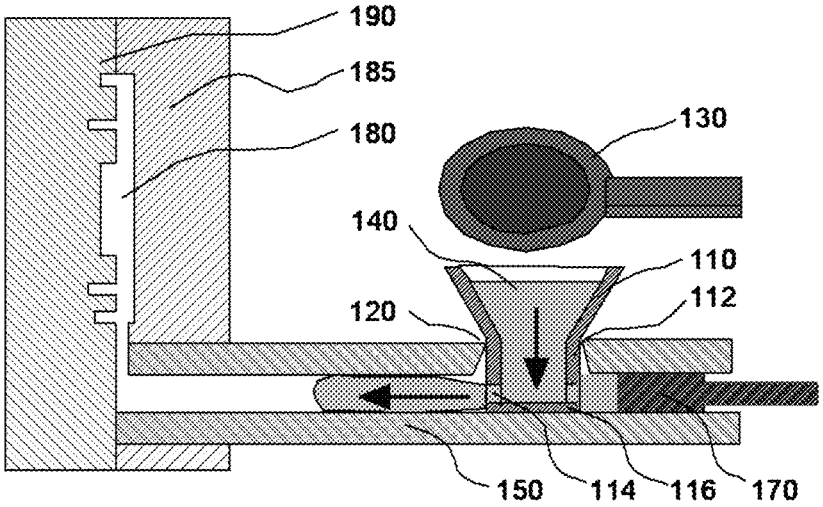
FIG. 2 is a schematic view of a layout of one embodiment of the present invention.

The present invention is proposed based on new ideas in the delaying formation of erosion pit under pour hole during die casting process. FIG. 2 illustrates the one of the ideas. Instead of pouring a molten metal 140 directly into a shot sleeve 150 through the pour hole 120 as shown in FIG. 1, the molten metal 140 is provided from a delivering vessel such as a ladle 130, a launder, or a pipeline connected to a molten metal pump into a cup 110 that is placed over the pour hole 120 on the shot sleeve 150. The cup 110 has a top opening area greater than that of the pour hole 120 to allow easy pouring. Molten metal 140 poured into the cup 110 then flows down along the wall of a tunnel 112, hits the bottom wall or the bottom plate 116 connecting to the tunnel 112, and finally exits from a plurality of outlets 114. The tunnel 112 smoothes the downward flow as shown by the vertical arrow in FIG. 2 and reduced the impact of molten metal 140 on its bottom wall 116. The exit 114 minimizes the flow component of the molten metal 140 normal to the surface of the shot sleeve 150 and enhances the flow component parallel to the surface of the shot sleeve 150 as shown by the horizontal arrow in FIG. 2. This is an important feature of the present invention since steel erosion is much less by molten aluminum when the flow direction of the molten aluminum is parallel to the internal surface of the shot chamber than that when the flow direction of the molten aluminum is normal to the internal surface of the shot chamber. The use of a plurality of exit 114 and a tunnel 112 slows down the formation of erosion pit on the internal surface of the shot sleeve 150 and thus extends the service life of the shot sleeve 150. The use of a plurality of exit 114 and a tunnel 112 also reduces the splashing of the melt front, resulting in reduced oxide formation and entrapped gases in the molten metal 140.

In a preferred embodiment, the present invention relates to a method and a device for extending the service life of a shot sleeve wherein the tunnel 112 is connected to the cup 110, forming a flow channel allowing the molten metal 140 to flow through as shown in FIG. 2. The temperature of the cup 110 can be controlled by means of conventional cooling or heating. Flow rates of molten metal 140 in the flow channel are controlled by the smallest cross-sectional area of the flow channel, either in the tunnel 112 or at the exit 114. The device consists of solid materials such as steels, cast irons, ceramic materials, or refractory materials, or a combination of these solid materials. Erosion mainly occurs on the bottom wall 116 of the tunnel 112. The entire device, especially the bottom wall 116 of the tunnel 112, can be made of steel and serves as a sacrificial device to protect the shot chamber. Such a device is much less costly than the shot chamber. Conventional coatings used in the metal casting industry can be used on the surfaces of the device that are in contact with the molten metal 140. One of such coatings is boron nitride coatings. Applying a boron nitride coating on the surfaces of the device extends the service life of the device. Portion of the device that is in contact with the molten metal, especially the bottom wall 116 and the cup 110, can be made of a refractory material such as a ceramic material or a refractory metallic material including titanium alloy, tungsten alloy, molybdenum alloy, ruthenium alloy, tantalum alloy, niobium alloy and etc. Since the bottom wall 116 of the tunnel 112 can be made of thin sheet material, the costs of using the device of the present invention are much lower than that of the liners for a shot chamber described by U.S. Pat. No. 3,786,552 to Saito et al and by U.S. Pat. No. 9,114,455 to Donahue et al.

In another preferred embodiment, the present invention relates to a method and a device for extending the service life of a shot sleeve wherein the device consisting of a cup 110, a tunnel 112, a bottom wall 116, and a plurality of exits 114 shown in FIG. 2 can be rotated or translated linearly by physical means either mechanically or manually. Any selected motion, rotation or translation, after a certain preselected number of shots, allows the molten metal 140 during successive pours to impact regions on the surface of the shot sleeve 150 where severe erosion has yet to form during prior shots. Such a motion of the device produces erosion regions having a much greater total area than that of the erosion pit 160 under the pour hole 120 shown in FIG. 1. As a result, any motion of the device is beneficial in slowing down the formation of a deep erosion pit that leads to the failure of the shot sleeve. Optimized motion of the device could significantly enhance the service life of a shot sleeve. To ensure a constant process control, conventional heat and cooling techniques can be used to control the temperature of the cup 110 so that the initial conditions for each shot can be maintained identical. Conventional coatings such as boron nitride coatings can be applied on the surfaces of the device to extend its service life.

To produce die casting shot-by-shot continuously, the device shown in FIG. 2 has to be lowered into the shot chamber 150 to receive molten metal 140. After the molten metal 140 is delivered into the shot chamber 150, the device has to be transferred out of the shot chamber 150 to allow ram 170 to push the molten metal 140 to fill die cavity 180. A mechanical means of transporting the device in and out of the shot chamber 150 is required so die castings can be made shot-after-shot. The mechanical means can also be used to rotate the device so that the exits 114 direct the molten metal 140 at different locations in the shot chamber 150. The mechanical means can also be used to place the exits 114 at different distance from the bottom of the shot chamber 150. Molten metal 140 will impact different locations when the exits 114 are at different distances from the bottom of the shot chamber 150. By rotating or translating the device shown in FIG. 2, molten metal 140 can be spread over much greater area than that under the pour hole 120 as shown in FIG. 1. This would be beneficial in significantly delay the formation of a deep erosion pit on the shot chamber, which is the main reason for the failure of the shot chamber 150 during die casting operation. The mechanical means of rotating or translating the device of this present invention can be achieved manually or mechanically, for instance, using a robot.

Figure 3:
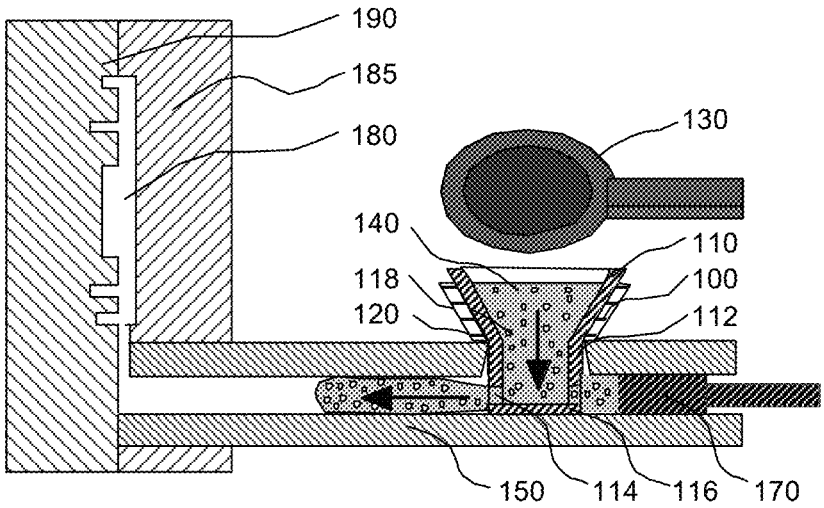
FIG. 3 is a schematic view of a layout of one embodiment of the present invention.

In another preferred embodiment, the present invention relates to a method and a device for extending the service life of a shot chamber shown in FIGS. 2 and 3. The tip of the tunnel can be placed in the pour hole 120 so that molten metal 140 existing from outlet 114 directly impacts the side wall of the pour hole 120 and then flow along the internal side wall of the shot chamber 150. Since the side wall of the pour hole 120 is not a working surface of the shot chamber 150, erosion on the side wall of the pour hole 120 will not lead to the failure of the shot chamber 150. Flow of the molten metal 140 along the side wall of the shot chamber 150 would be much smoother than that using the prior art shown in FIG. 1. Since the tip of the tunnel 112 and thus the outlets 114 are in the pour hole, the existence of the device does not interfere with the motion of the ram 170. As a result, the device of this present invention does not need to be translated into and out of the pour hole 120 for each production cycle or shot.

In another preferred embodiment, the present invention relates to a method and a device for extending the service life of a shot sleeve and for seasoning the molten metal that flows through the device. As shown in FIG. 3, the cup 110 is coupled with an agitator 100 which is driven by a physical means including acoustic, mechanical, electrical, magnetic field or a combination of these fields. Molten metal 140 poured from the ladle 130 or a vessel including a launder or a pipeline into the cup 110 is seasoned by melt agitation caused by the agitator 100. The contact time of the molten metal 140 in the cup 110 can be controlled by the dimensions of the tunnel 112 or the outlet 114. The seasoning of the molten metal 140 during a controlled contact time results in 1) the formation of a large number of small and spherical solid grains 118 in the molten metal 140 containing a fraction of solids smaller than 0.2 by weight, and 2) reduced temperature of the molten metal 140. Erosion of shot sleeve 150 is reduced when the temperature of the molten metal 140 is reduced. Existence of a large number of small and spherical grains 118 inhibits the formation of dendrites in the shot sleeve 150. Dendrites formed in the shot sleeve 150 tend to choke the flow of the melt when it is driven by ram 170 to fill cavity 180 defined by molds 185 and 190. To ensure a constant process control, conventional heat and cooling techniques can be used to control the temperature of the cup 110 so that the initial conditions for each pour and the extent of seasoning of molten metal 140 can be maintained identical. Conventional coatings such as boron nitride coatings can be applied on the surfaces of the device to extend its service life.

Agitator 100 shown in FIG. 3 works best when molten metal 140 in the cup 110 is cooled by controlled cooling. A combined effect of external field from the agitator 100 and cooling is more effective than the external field alone in promoting the formation of spherical grains 118 from the molten metal 140 [15-16]. Molten metal 140 containing spherical grains 118 can be die cast at temperatures much lower than the liquidus temperature of the alloy, resulting in much lower tendency of erosion pit formation on shot sleeve 150, and soldering formation on molds 185 and 190 [1, 5, 7]. Castings solidified from slurry containing spherical grains usually have much higher ductility and internal integrity than that solidified from a completely molten metal [13].

It has to be noted that the agitator 100 shown in FIG. 3 is symbolic. The agitator 100 can be a physical device that attached on the cup 110 when a field is applied through to cup 110 to agitate the molten metal 140 in the cup 110. Such a field includes high-intensity ultrasonic vibration, mechanical or acoustic vibrations, alternating electromagnetic field, pulsed electrical current, or pulsed magnetic oscillation, or a combination of these fields. These fields are effective in producing spherical solid grains 118 from molten metal 140 in the cup 110. The agitator 100 can also be a solid stirrer such as an impeller or just simply a rod that submerged in the molten metal 140 in the cup 110 for stirring and rapidly cooling the molten metal 140. The agitator 100 can also be a tube submerged in molten metal 140 in the cup 110. Through the tube an inert gas is purged into the molten metal for stirring and rapidly cooling the molten metal 140. Such stirring coupled with rapid cooling of the molten metal 140 is effective in producing solid spherical grains 118 from the molten metal 140 in the cup 110.

The invention further provides examples of extending the service life of a shot sleeve using the present invention. The examples provided below are meant merely to exemplify several embodiments, and should not be interpreted as limiting the scope of the claims, which are delimited only by the specification.

Example 1

Figure 4:
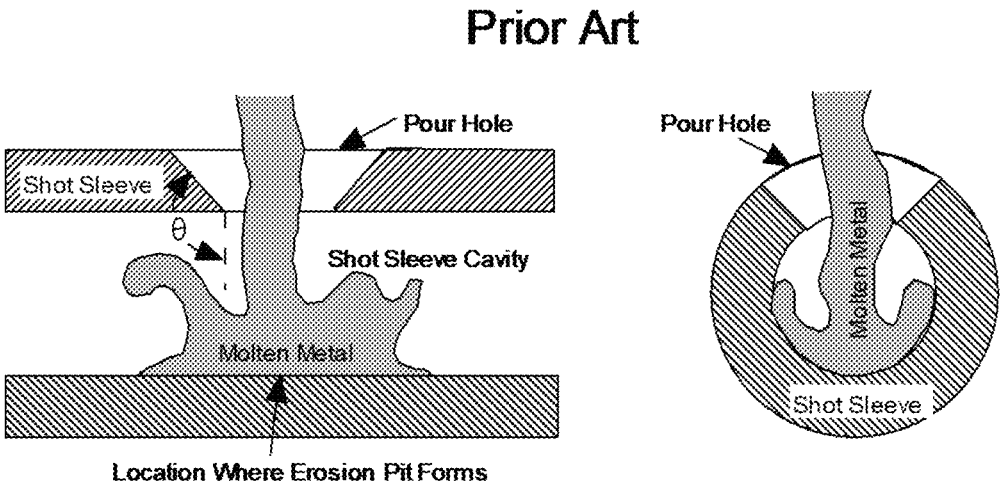
FIG. 4 is a schematic view of a layout of a prior art on the splashing formation during the initial stage of melt pouring during a cold-chamber die casting process.

FIG. 4 illustrates the turbulent flow of molten metal pouring during the initial pouring of the molten metal into the cavity of a shot sleeve in a conventional die casting process (only a portion of a shot sleeve near the pour hole is shown in FIG. 4). There are two issues associated with the conventional pouring process: 1) splashing and 2) localized impact of the molten metal on the bottom surface of a shot sleeve cavity under the pour hole.

As the molten metal is poured into the shot sleeve under the influence of gravity, the flow front impacts the bottom of the shot sleeve cavity, forming a splashing. The splashing causes increased formation of oxide films on the free surfaces of the molten metal. The splashing also tends to entrap the oxide films and gases into the molten metal. Both entrapped oxide films and gases are detrimental to the mechanical properties of the resultant casting. The impact causes increased erosion of the shot sleeve under the pour hole, eventually forming an erosion pit at the impact location because the same location is repeatedly impacted by molten metal shot-after-shot. The size of the erosion pit is proportional to the size of the pour hole. The depth of the pit is proportional to the impact intensity and number of shots.

Example 2

Figure 5:
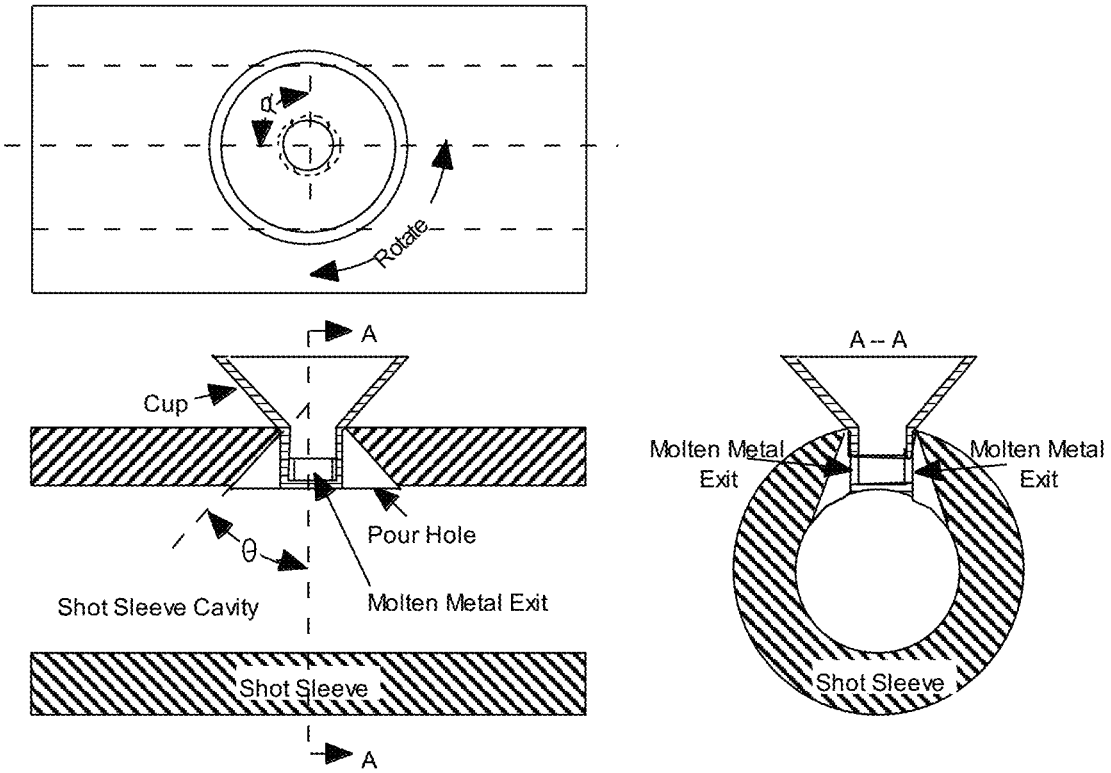
FIG. 5 is a schematic view of a layout of one embodiment of the present invitation.

Reducing the impact of molten metal on the bottom surface of the shot sleeve cavity reduces molten metal splashing and delays the formation of a deep erosion pit under the pour hole. FIG. 5 illustrates an example of the present invention in reducing splashing and in delaying the formation of a deep erosion pit on the internal surface of a shot sleeve. In FIG. 5, $\alpha$ is the angle between the axis of a molten metal outlet and the axis of the shot sleeve. $\theta$ is the angle between the axis of the cup and the side surface of the pour hole. The device of the present invention includes a cup, a tunnel located within the pour hole, and a plurality of outlets located at one end of the tunnel. The device can be rotate at any $\alpha$. It can also be translated vertically in or out of the pour hole. The cross-sectional shapes of the cup, the tunnel and the outlet can be any geometry that allows molten metal to flow through to feed the shot sleeve cavity. Conventional heating or cooling can be applied on the cup to maintain the cup at selected temperatures before each shot. Conventional coatings such as boron nitride coatings can be applied on the surfaces of the device to extend its service life.

A cup is placed on a shot sleeve as shown in FIG. 5. A tunnel extends the cup into the pour hole of the shot sleeve. The tunnel doesn't extend into the shot sleeve cavity so that the existence of the device does not interfere with the ram (the device can also be pulled out of the pour hole manually or mechanically) when it travels to push the molten metal in the shot sleeve. The pour hole is made such that the angle $\theta$ is smaller than 90° (in the prior art shown in FIG. 4, $\theta$ is greater than 90°). When $\theta$ is smaller than 90°, the smaller opening on top of the pour hole serves as a means of supporting the cup and the large opening at the bottom of the pour hole provides space for molten metal to exit from the tunnel. Molten metal flowing out of the outlet would impact the side wall of the pour hole and then flow along the side wall of the shot sleeve cavity down to the bottom of the cavity. Such a flow is much smoother than that the flow caused by pouring outside of the pour hole as illustrated in FIG. 4.

There are a few advantages using the present invention illustrated in FIG. 5 over the prior art illustrated in FIG. 4. First, sideway flow is caused as the melt flows out of the outlet and hits the side wall of the pour hole. Such a sideway flow has much less impact intensity than the direct vertical impact shown in FIG. 4. Second, for each shot, the amount of molten metal that hits an impact location is much less than the prior art as a plurality of outlets is used in the present invention, leading to less erosion on each impact location. Third, the molten metal impacts only the bottom wall of the tunnel and the side wall of the pour hole. These surfaces are not the working surface of a shot sleeve. The tunnel is inexpensive and can serve as sacrificial device. Erosion on the side wall of the pour hole is unlikely to affect the functioning of a die casting machine. Fourth, the impact location on the side wall of a pour hole can be changed by rotating the device to change the angle $\alpha$. Thus, an even erosion of the side wall of the pour hole can be achieved simply by rotating the device. Finally, the erosion of the side wall of the shot chamber is caused when molten metal flows over it. Such erosion is much less severe than erosion due to molten metal impact. Furthermore, rotation of the device allows molten metal to flow over much greater surface area of the side wall of the shot sleeve cavity than that of prior art. As a result, erosion on the working surface of the shot sleeve could be significantly reduced.

Example 3

Figure 6:
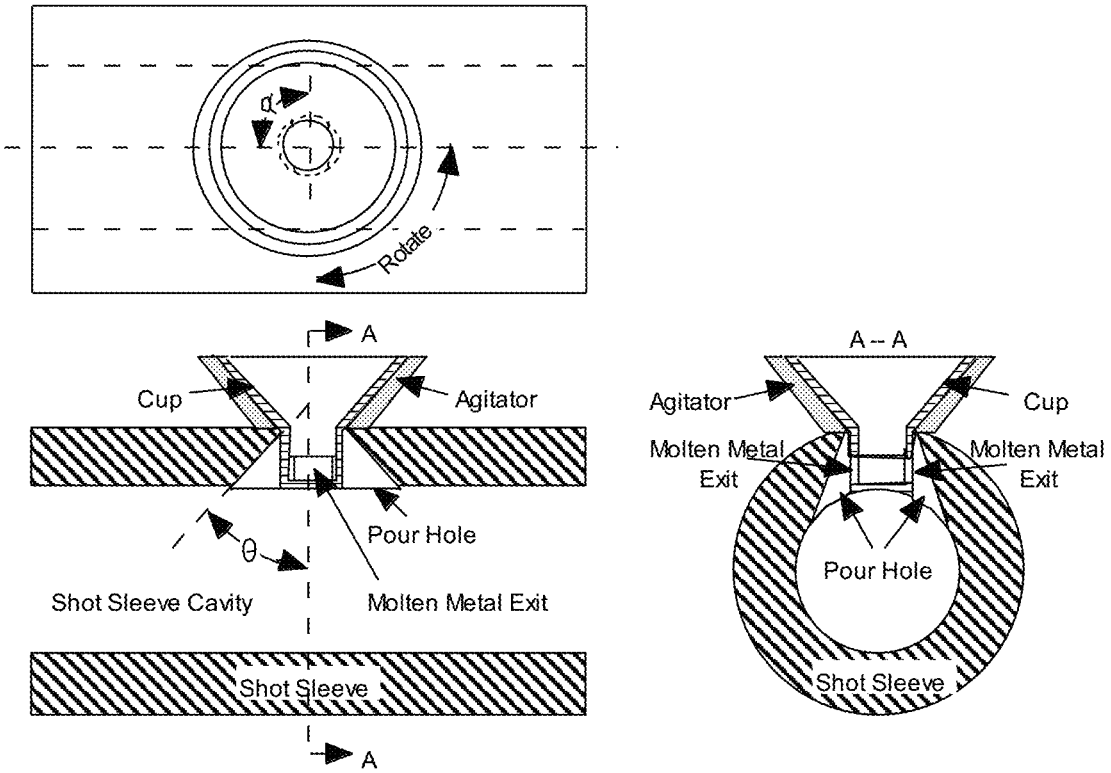
FIG. 6 is a schematic view of a layout of one embodiment of the present invitation.

FIG. 6 illustrates an example using an agitator to season the molten metal in the cup. In FIG. 6, α is the angle between the axis of a molten metal outlet and the axis of the shot sleeve. θ is the angle between the axis of the cup and the side surface of the pour hole. The device of the present invention includes a cup, an agitator coupled to the cup, a tunnel located within the pour hole, and a plurality of outlets located at one end of the tunnel. The device can be rotate at any α. It can also be translated vertically in or out of the pour hole. The cross-sectional shapes of the cup, the tunnel and the outlet can be any geometry that allows molten metal to flow through to feed the shot sleeve cavity. The agitator is driven by physical means including high intensity ultrasonic vibration, mechanical vibration, alternating electrical field, alternating mechanical field, or a combination of a number of physical means. Conventional means of cooling can be applied on the cup to assist the agitation for the seasoning of the molten metal. Conventional heating or cooling can be applied on the cup to maintain the cup at selected temperatures before each shot. Conventional coatings such as boron nitride coatings can be applied on the surfaces of the device to extend its service life.

A cup is placed on a shot sleeve as shown in FIG. 6. A tunnel extends the cup into the pour hole of the shot sleeve. The tunnel doesn't extend into the shot sleeve cavity so that the existence of the device does not interfere with the ram (the device can also be pulled out of the pour hole manually or mechanically) when it travels to push the molten metal in the shot sleeve. The pour hole is made such that the angle θ is smaller than 90° (in the prior art shown in FIG. 4, θ is greater than 90°). When θ is smaller than 90°, the smaller opening on top of the pour hole serves as a means of supporting the cup and the large opening at the bottom of the pour hole provides space for molten metal to exit from the tunnel. Molten metal flowing out of the outlet would then flow along the side wall of the shot sleeve cavity down to the bottom of the cavity. Such a flow is much smoother than the flow caused by pouring the molten metal outside of the pour hole as illustrated in FIG. 4.

The use of the agitator is to produce spherical solid grains from the molten metal. To do that, the molten metal has to stay in the cup for certain amount of time to be stirred by the agitator driven by physical means. When a given amount of molten metal is transferred into the cup, the stay time of the molten metal in the cup is determined by the cross sectional area of the outlet or the tunnel depending on which one is smaller. The outlet or the tunnel can be designed to ensure that a large portion of the molten metal that has been transferred into the cup stays longer than a certain critical time before entering the shot sleeve cavity. Solid dendrites that form the molten metal in the cup need a certain amount of time to be broken into fragments which then coarsen to form spherical particles under the stirring caused by the agitator. Molten metal containing spherical grains can be cast at temperatures much lower than the liquidus of the alloy.

Physical means for driving the agitator includes high-intensity ultrasonic vibration, mechanical or acoustic vibrations, alternating electromagnetic field, pulsed electrical current, or pulsed magnetic oscillation, or a combination of these fields. The agitator can also be an immersion stirrer in the cup to stir the molten metal. The agitator can also be a tube that submerges in the molten metal in the cup to transport an inert gas such as argon or nitrogen into the molten metal. The cold inert gas delivered out of the tube becomes bubbles that stir and rapidly cool the molten metal, forming a fraction of small and spherical solid grains from the molten metal in the cup.

There are a few advantages using the present invention illustrated in FIG. 6 over the prior art illustrated in FIG. 4. First, sideway flow is caused as the melt flows out of the outlet and hits the side wall of the pour hole. Such a sideway flow has much less impact intensity than the direct vertical impact shown in FIG. 4. Second, for each shot, the amount of molten metal that hits an impact location on the side wall of the pour hole is much less than the prior art as a plurality of outlets is used in the present invention, leading to less erosion on each impact location. Third, the molten metal impacts only the bottom wall of the tunnel and the side wall of the pour hole. These surfaces are not the working surfaces of a shot sleeve. The tunnel is inexpensive and can serve as sacrificial device. Erosion on the side wall of the pour hole is unlikely to affect the functioning of a die casting machine. Fourth, the impact location on the side wall of a pour hole can be changed by rotating the device to change the angle α. Thus, an even erosion of the side wall of the pour hole can be achieved simply by rotating the device. Fifth, the erosion of the side wall is caused when molten metal flows over it. Such erosion is much less severe than erosion due to molten metal impact. Furthermore, rotation of the device allows molten metal to flow over much greater surface area of the side wall of the shot sleeve cavity than that of prior art. Finally, the use of the agitator, combined with conventional cooling of the cup, can lower the temperature of the molten metal before it enters the shot sleeve. Erosion of shot sleeve and die tooling can be reduced significantly by reducing the temperature of the molten metal or slurry. Another advantage of the present invention shown in FIG. 6 is that semisolid slurry can be produced in the cup for die casting. Components made by semisolid materials are known to be stronger and tougher than that of non-semisolid materials.

Example 4

Figure 7:
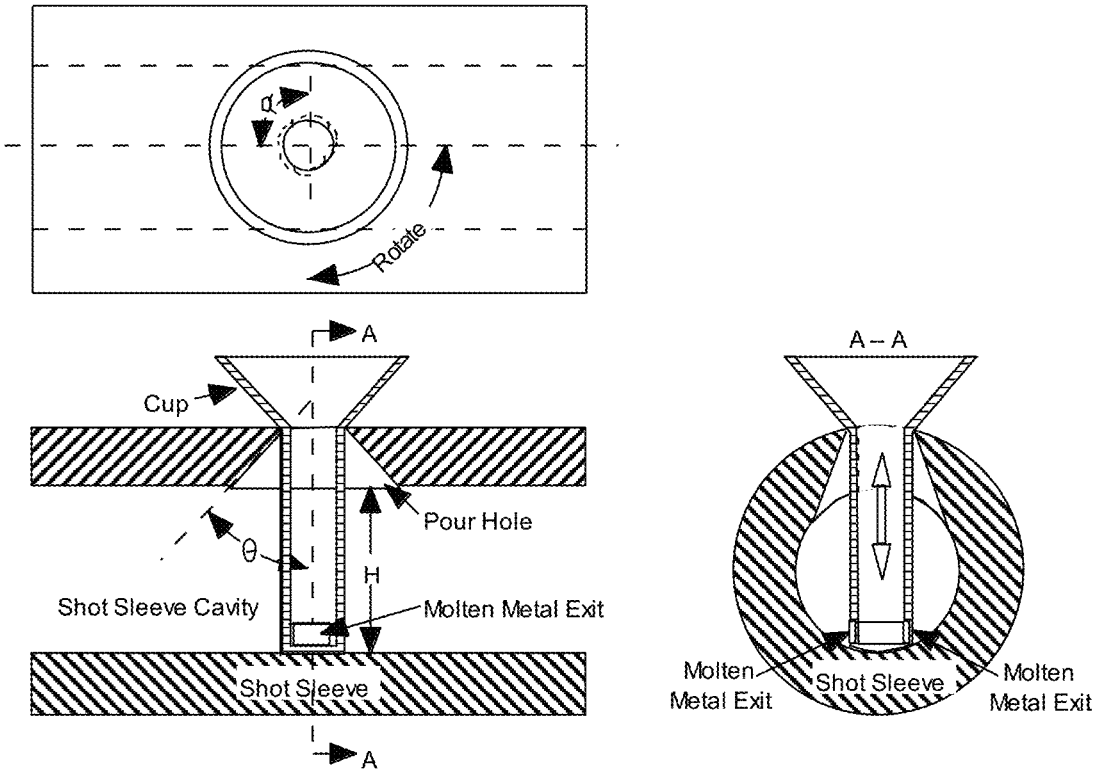
FIG. 7 is a schematic view of a layout of one embodiment of the present invitation.

FIG. 7 illustrates an example of reducing the molten metal impact on splashing formation and on erosion of shot sleeve. In FIG. 7, α is the angle between the axis of a molten metal outlet and the axis of the shot sleeve. θ is the angle between the axis of the cup and the side surface of the pour hole. The device of the present invention shown in FIG. 7 includes a cup, a tunnel located within the shot sleeve with the tip of the tunnel about H distance away from the bottom of the shot sleeve cavity, and a plurality of outlets located near the tip of the tunnel. H can of any value between zero and the diameter of the shot sleeve cavity for a given shot. The device can be rotate at any α. It can also be translated vertically in the pour hole before pouring and out of the pour hole after pouring to allow ram traveling in the shot sleeve. The cross-sectional shapes of the cup, the tunnel and the outlet can be any geometry that allows molten metal to flow through to feed the shot sleeve cavity. Conventional heating or cooling can be applied on the cup to maintain the cup at selected temperatures before each shot. Conventional coatings such as boron nitride coatings can be applied on the surfaces of the device to extend its service life.

A cup is placed on a shot sleeve as shown in FIG. 7. A tunnel extends the cup into the shot sleeve cavity. The pour hole is made such that the angle θ is smaller than 90° (in the prior art shown in FIG. 4, θ is greater than 90°). When θ is smaller than 90°, the smaller opening on top of the pour hole serves as a means of supporting the cup. Molten metal flowing out of the outlet would feed the shot sleeve close to the bottom of the shot sleeve cavity. Such a flow is much smoother than the flow caused by pouring out side of the pour hole as illustrated in FIG. 4.

There are a few advantages using the present invention illustrated in FIG. 7 over the prior art illustrated in FIG. 4. First, sideway flow is caused as the melt flows out of the outlet. Such a sideway flow has much less impact intensity than the direct vertical impact shown in FIG. 4. Second, for each shot, the amount of molten metal that hits an impact location on the shot sleeve is much less than the prior art as a plurality of outlets is used in the present invention, leading to less erosion on each impact location. Third, the molten metal mainly impacts the bottom wall of the tunnel. The tunnel is inexpensive and can serve as sacrificial device. The impact of molten metal on the shot sleeve is much less severe using the present invention shown in FIG. 7 than that using the conventional pour shown in FIG. 4. Finally, the impact location on the shot sleeve can be changed by rotating the device to change the angle α or by altering H. Assuming conservatively that the same number of shot, N, can be achieved at each impact location before the erosion pit becomes deep enough using the present invention as the prior art shown in FIG. 4, another N shots can be made simply by changing a or H so that the molten metal impact another new location on the shot sleeve. As a result, the service life of a shot sleeve can be extended many times more using this present invention than using the prior art shown in FIG. 4.

Example 5

Figure 8:
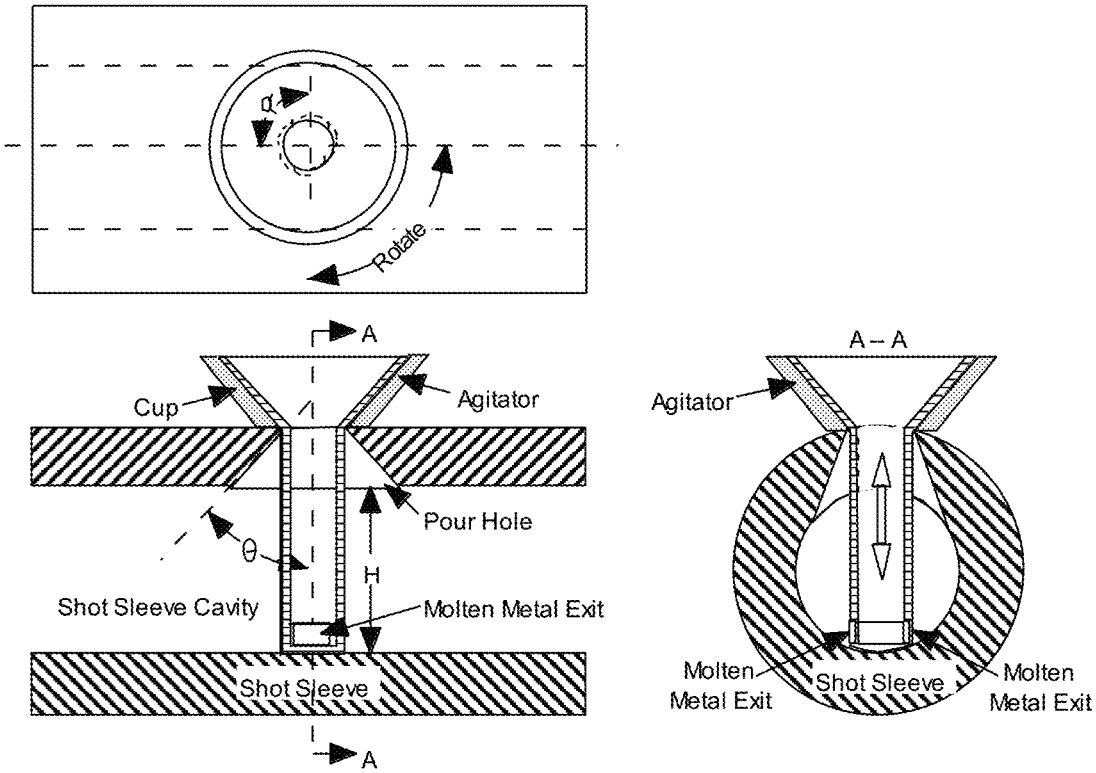
FIG. 8 is a schematic view of a layout of one embodiment of the present invitation.

FIG. 8 illustrates an example using an agitator to season the molten metal in the cup. In FIG. 8, α is the angle between the axis of a molten metal outlet and the axis of the shot sleeve. θ is the angle between the axis of the cup and the side surface of the pour hole. The device of the present invention includes a cup, an agitator coupled to the cup, a tunnel located within the shot sleeve with the tip of the tunnel about H distance away from the bottom of the shot sleeve cavity, and a plurality of outlets located near the tip of the tunnel. H can of any value between zero and the diameter of the shot sleeve cavity for a given shot. The device can be rotate at any α. It can also be translated vertically in or out of the pour hole. The cross-sectional shapes of the cup, the tunnel and the outlet can be any geometry that allows molten metal to flow through to feed the shot sleeve cavity. The agitator is driven by physical means including high intensity ultrasonic vibration, mechanical vibration, alternating electrical field, alternating mechanical field, or a combination of a number of physical means. Conventional means of cooling can be applied on the cup to assist the agitation for the seasoning of the molten metal. Conventional heating or cooling can be applied on the cup to maintain the cup at selected temperatures before each shot.

A cup is placed on a shot sleeve as shown in FIG. 8. A tunnel extends the cup into the shot sleeve cavity. The pour hole is made such that the angle θ is smaller than 90° (in the prior art shown in FIG. 4, θ is greater than 90°). When θ is smaller than 90°, the smaller opening on top of the pour hole serves as a means of supporting the cup. Molten metal flowing out of the outlet would feed the shot sleeve close to the bottom of the shot sleeve cavity. Such a flow is much smoother than the flow caused by pouring outside of the pour hole as illustrated in FIG. 4.

The use of the agitator is to produce spherical solid grains from the molten metal. To do that, the molten metal has to stay in the cup for certain amount of time to be stirred by the agitator driven by physical means. When a given amount of molten metal is transferred into the cup, the stay time of the molten metal in the cup is determined by the cross sectional area of the outlet or the tunnel depending on which one is small. The outlet or the tunnel can be designed to ensure that a large portion of the molten metal that has been transferred into the cup stays longer than a certain critical time before entering the shot sleeve cavity. Solid dendrites that form the molten metal in the cup need a certain amount of time to be broken into fragments which then coarsen to form spherical particles under the stirring caused by the agitator. Molten metal containing spherical grains can be cast at temperatures much lower than the liquidus of the alloy.

Physical means for driving the agitator includes high-intensity ultrasonic vibration, mechanical or acoustic vibrations, alternating electromagnetic field, pulsed electrical current, or pulsed magnetic oscillation, or a combination of these fields. The agitator can also be an immersion stirrer in the cup to stir the molten metal. The agitator can also be a tube that submerges in the molten metal in the cup to transport an inert gas such as argon or nitrogen into the molten metal. The cold inert gas delivered by the tube becomes bubbles that stir and rapidly cool the molten metal, forming a fraction of small and spherical solid grains from the molten metal in the cup.

There are a few advantages using the present invention illustrated in FIG. 8 over the prior art illustrated in FIG. 4. First, sideway flow is caused as the melt flows out of the outlet. Such a sideway flow has much less impact intensity than the direct vertical impact shown in FIG. 4. Second, for each shot, the amount of molten metal that hits an impact location on the shot sleeve is much less than the prior art as a plurality of outlets is used in the present invention, leading to less erosion on each impact location. Third, the molten metal mainly impacts the bottom wall of the tunnel. The tunnel is inexpensive and can serve as sacrificial device. The impact of molten metal on the shot sleeve is much less severe using the present invention shown in FIG. 8 than that using the conventional pour shown in FIG. 4. Fourthly, the impact location on the shot sleeve can be changed by rotating the device to change the angle α or by altering H. Assuming conservatively that the same number of shot, N, can be achieved at each impact location before the erosion pit becomes deep enough using the present invention as the prior art shown in FIG. 4, another N shots can be made simply by changing a or H so that the molten metal impact another new location on the shot sleeve. As a result, the service life of a shot sleeve can be extended many times more using this present invention than using the prior art shown in FIG. 4. Finally, the use of the agitator, combined with conventional cooling of the cup, can lower the temperature of the molten metal before it enters the shot sleeve. Erosion of shot sleeve and die tooling can be reduced significantly by reducing the temperature of the molten metal or slurry. Another advantage of the present invention shown in FIG. 8 is that semisolid slurry can be produced in the cup for die casting. Components made by semisolid materials are known to be stronger and tougher than that of non-semisolid materials.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. Q. Han, C. Vian, and J. Good, "*Application of Refractory Metals to Facilitate Hot Changer Aluminum Die Casting,*" *International Journal of Metalcasting,* 15 (2021) 411-416.
2. Q. Han, and J. Zhang, "*Fluidity of Alloys under High-Pressure Die Casting Conditions: Flow-Choking Mechanisms,*" *Metallurgical and Materials Transactions B,* 51 (4) (2020) 1795-1804.
3. A. B. William, and S. Midson, *Shot System Components User's Guide*, NADCA Publication: 525, NADCA 2016.
4. J. Song, T. DenOuden, and Q. Han, "Mechanisms of Soldering Formation on Coated Core Pins", *Metalurgical and Materials Transactions A,* 43A (2012) 415-421.
5. Q. Han, and S. Viswanathan, "Analysis of the Mechanism of Die Soldering in Aluminum Die Casting", *Metallurgical and Materials Transaction A,* 34A, (2003) 139-146.
6. Y. Chu, P. Cheng, and R. Shivpuri "A Study of Erosive Wear in Die Casting Dies: Surface Treatments and Coatings," *NADCA Transactions* 1993, pp. 361-371.
7. Q. Han, "Mechanism of Die Soldering during Aluminum Die Casting," *China Foundry,* 12 (2) (2015) 136-143.
8. R. Donahue, "Avoiding Washout in Shot Sleeve When Used with Low Iron, Structural Aluminum Die Casting Alloys", *NADCA Transactions* 2013, T13-051.
9. R. Donahue, S. Knickel, P. Schneider, M. Witzel, J. Melius, and A. Monroe, "Performance of Shot Sleeve with Different Refractory Metal Liners in Casting of Structural Aluminum Die Casting Alloy 362", *NADCA Transactions* 2014, T14-011.
10. Q. Han, "A Model Correlating Fluidity to Alloy Variables in Hypoeutectic Alloys," *Acta Materialia,* 228 (2022) 117587.
11. Q. Han, H. Xu, "Fluidity of Alloys under High Pressure Die Casting Conditions," *Scripta Materialia,* 53 (2011) 7-10.
12. Q. Han, S. Viswanathan, "The Use of Thermodynamic Simulation for the Selection of Hypoeutectic Aluminum-Silicon Alloys for Semi-Solid Metal Processing", *Materials Science and Engineering A,* 364 (2004) 48-54.
13. M. C. Flemings, "Behavior of Metal Alloys in the Semisolid State," *Metallurgical Transaction B,* 22B (1991) 269-293.
14. X. Jian, H. Xu, T. T. Meek, Q. Han, "Effect of Ultrasound on Solidification of Aluminum A356 Alloy", *Materials Letters,* 59 (2005) 190-193.
15. C. Vian, C. Kibbey, C. Kurtz, Q. Han, "Cooling-Assisted Ultrasonic Grain Refining of Aluminum E380 Die Cast Alloy", *International Journal of Metalcasting,* 16 (2) (2022) 842-852.
16. Q. Han, "Ultrasonic Processing of Materials", *Metallurgical and Materials Transactions B,* 46B (2015) 1603-1614.
17. R. Martinez, A. Figueredo, J. A. Yurko, M. C. Flemings, "Efficient Formation of Structures Suitable for Semisolid Forming", NADCA Transactions 2001, 47-54.
18. M. C. Flemings, R. G. Riek, K. P. Young, "Rheocasting", Materials Science and Engineering, 25 (1976) 103-107.
19. D. H. Kirkwood, "Semisolid Metal Processing", International Materials Reviews, 39 (1994) 173-189.
20. J. Wannasin, R. A. Martinez, M. C. Flemings, "Grain Refinement of an Aluminum Alloy by Introducing Gas Bubbles during Solidification", Scripta Materialia, 55 (2006) 115-118.

What is claimed is:

1. An apparatus for receiving a molten metal from a vessel, then seasoning and delivering the received molten metal, comprising:

a horizontal shot chamber with a pour hole located on a top wall of the shot chamber, wherein a side wall of the pour hole is designed to lead the molten metal into the shot chamber;

a cup for receiving the molten metal from said vessel;

a baffle plate or a bottom plate absorbing impact of the molten metal during pouring and altering flow direction of the molten metal;

a tunnel leading the molten metal from the cup downward towards the shot chamber, one end of the tunnel connecting to the cup and the other end connecting to the baffle plate;

a plurality of side outlets at the other end of the tunnel allowing the received molten metal to flow out of the tunnel, to contact the side wall of the pour hole and then flow along an inner side wall of the shot chamber, wherein the flow rates of the molten metal in the said apparatus is controlled by the size of said tunnel or said plurality of side outlets;

wherein the apparatus is arranged such that said plurality of side outlets are directed at selected locations and orientations in the pour hole so that molten metal impacts the inner side wall of the pour hole, wherein the molten metal is seasoned in the cup held at predetermined temperatures, impacts the side wall of the pour hole, and flows along the inner side wall of the shot chamber to reduce erosion of the shot chamber under the pour hole and wherein the pour hole of the shot chamber has its top opening smaller than its bottom opening.

2. The apparatus of claim 1, wherein the cup includes a cooling device to maintain the cup at predetermined temperatures prior to each shot, or each production cycle, using a fluid including water, compressed air, or a combination of multiple fluids.

3. The apparatus of claim 1, wherein the apparatus has walls made of a material having its melting temperature higher than 900° C. selected from a group of materials consisting of steels, cast irons, refractory metallic alloys, and ceramic materials.

4. The apparatus of claim 1, wherein the internal walls of the apparatus in contact with the molten metal are provided with a coating including a boron nitride coating.

5. The apparatus of claim 1 further includes an agitator for stirring the molten metal in the cup by a field for a selected duration to produce a fraction of non-dendritic spherical solid grains in the molten metal.

6. The apparatus of claim 5, wherein the field includes high-intensity ultrasonic vibrations, alternating electrical or magnetic field, mechanical vibrations, or a combination of these fields.

7. The apparatus of claim 6, wherein said high-intensity ultrasonic vibrations cause portion of walls of the cup vibrating with a power intensity greater than 100 $W/cm^2$ at frequencies between 15,000 to 500,000 Hz.

8. The apparatus of claim 5, wherein the agitator is an impeller or a rod that is submerged in the molten metal for stirring and rapidly cooling the molten metal in the cup.

9. The apparatus of claim 5, wherein the agitator is a tube submerged in the molten metal in the cup, through the tube an inert gas is purged into the molten metal for stirring and rapidly cooling the molten metal in the cup.

* * * * *